US011030940B2

(12) United States Patent
Watson et al.

(10) Patent No.: US 11,030,940 B2
(45) Date of Patent: Jun. 8, 2021

(54) DISPLAY ARRAY WITH DISTRIBUTED AUDIO

(71) Applicant: X Development LLC, Mountain View, CA (US)

(72) Inventors: Philip Watson, Felton, CA (US); Raj B. Apte, Palo Alto, CA (US)

(73) Assignee: X Development LLC, Mountain View, CA (US)

( * ) Notice: Subject to any disclaimer, the term of this patent is extended or adjusted under 35 U.S.C. 154(b) by 0 days.

(21) Appl. No.: 16/403,154

(22) Filed: May 3, 2019

(65) Prior Publication Data

US 2020/0349880 A1 Nov. 5, 2020

(51) Int. Cl.

| | |
|---|---|
| ***G09G 3/32*** | (2016.01) |
| ***H04R 1/40*** | (2006.01) |
| ***H04R 3/12*** | (2006.01) |
| ***H04R 1/02*** | (2006.01) |

(52) U.S. Cl.

CPC ..... *G09G 3/32* (2013.01); *H04R 1/028* (2013.01); *H04R 1/403* (2013.01); *H04R 3/12* (2013.01); *G09G 2320/0666* (2013.01); *G09G 2380/02* (2013.01); *H04R 2499/15* (2013.01)

(58) Field of Classification Search

CPC ..... G09G 3/32; G09G 2320/0666; G09G 2380/02; H04R 1/028; H04R 1/403; H04R 3/12; H04R 2499/15

See application file for complete search history.

(56) References Cited

U.S. PATENT DOCUMENTS

| | | | | |
|---|---|---|---|---|
| 4,774,434 | A | 9/1988 | Bennion | |
| 5,162,696 | A | 11/1992 | Goodrich | |
| 8,059,921 | B2 | 11/2011 | Frohlich et al. | |
| 8,376,581 | B2 | 2/2013 | Auld et al. | |
| 9,532,136 | B2 | 12/2016 | Uhle et al. | |
| 9,991,423 | B2 | 6/2018 | Bower et al. | |
| 2009/0027566 | A1* | 1/2009 | Wargon | G06F 1/163 348/739 |
| 2012/0110447 | A1* | 5/2012 | Chen | G06F 3/0488 715/702 |
| 2013/0259270 | A1* | 10/2013 | Zhou | H04R 1/028 381/150 |

(Continued)

FOREIGN PATENT DOCUMENTS

| | | | |
|---|---|---|---|
| CN | 208489978 | U | 2/2019 |
| JP | 2018186410 | A | 11/2018 |
| WO | 2018234344 | A1 | 12/2018 |

OTHER PUBLICATIONS

"MEMS Microspeakers Are Truly Digital Transducers," audioxpress, published Aug. 27, 2015, https://www.audioxpress.com/waitress/follow/256, 5 pages.

(Continued)

*Primary Examiner* — Towfiq Elahi

(74) *Attorney, Agent, or Firm* — Christensen O'Connor Johnson Kindness PLLC

(57) ABSTRACT

A wallpaper-like audio/visual system includes a display array of display pixels to emit an image, an array of speakers to emit audio, and driver circuitry coupled to the display array and the array of speakers to drive the display pixels and the speakers with the first and second signals, respectively, in response to receiving audio and visual input signals. The speakers are interspersed amongst the display pixels.

22 Claims, 6 Drawing Sheets

(56) References Cited

U.S. PATENT DOCUMENTS

| | | | | |
|---|---|---|---|---|
| 2014/0311002 | A1 | 10/2014 | Meng | |
| 2015/0372051 | A1* | 12/2015 | Bower | H01L 33/50 257/89 |
| 2016/0080684 | A1* | 3/2016 | Farrell | H04N 9/8211 386/227 |
| 2017/0003440 | A1* | 1/2017 | Kim | H05K 1/0274 |
| 2018/0366514 | A1 | 12/2018 | Kimura | |
| 2019/0027534 | A1* | 1/2019 | Rotzoll | H01L 27/156 |
| 2019/0042041 | A1 | 2/2019 | Rothkopf et al. | |
| 2019/0187748 | A1* | 6/2019 | Lim | H01L 27/15 |

OTHER PUBLICATIONS

"MicroLED," Wikipedia, accessed Feb. 28, 2019, https://en.wikipedia.org/wiki/MicroLED, 3 pages.

Triggs, "Micro-LED paves the way for the 'smart display'," Android Authority, published Oct. 13, 2017, accessed Feb. 28, 2019, https://www.androidauthority.com/micro-led-smart-display-8052271, 4 pages.

"MicroLED displays technologies: cost reduction path for 75-inch 8K TV with 99.99% (4N) yield," Compound Semiconductor, published Sep. 4, 2018, accessed Feb. 28, 2019, https://compoundsemiconductor.net/article/105170/MicroLEDs_The_Path_To_Cost_Reduction, 2 pages.

Ahlberg, "Smart skin: Electronics that stick and stretch like a temporary tattoo," Illinois News Bureau, published Aug. 11, 2011, accessed Feb. 28, 2019, https:news.illinois.edu/view/6367/205260#image-5, 8 pages.

Larsen, "Sony showcases huge 8K microLED display," FlatpanelsHD, published Apr. 13, 2018, accessed Feb. 28, 2019, https://www.flatpanelshd.com/news.php?subaction=showfull&id=1523611680, 3 pages.

"MicroLED Displays 2018," From Technologies to Market, YOLE Développement, courtesy of Sony, 2018, 58 pages.

International Search Report and Written Opinion, dated Jul. 22, 2020, for corresponding International Patent Application No. PCT/US2020/028136, 11 pages.

* cited by examiner

DISPLAY ARRAY WITH DISTRIBUTED AUDIO

TECHNICAL FIELD

This disclosure relates generally to audio/visual display technologies.

BACKGROUND INFORMATION

Displays have grown in size and resolution to provide the viewer with an improved visual experience. The images portrayed are increasingly more realistic owing to the immersive experience of the large, high resolution displays. These large displays can be expensive because the cost to manufacture display panels increases exponentially with display area. This exponential cost increase arises from the increased complexity of large single-panel conventional displays, the decrease in yields associated with large displays (a greater number of components must be defect-free for large displays), and increased shipping, delivery, and setup costs. While the visual experience has dramatically improved over the last few decades, the audio experience has had less dramatic improvements. Accordingly, large immersive displays with reduced manufacturing costs, simplified transport and setup, and an improved realistic audio experience is desirable.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Embodiments of a system, apparatus, and method of operation for an audio/visual system having audio speakers interspersed amongst display pixels of a display array are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Conventional audio/visual display systems are typically rigid flat panel systems. For large displays (e.g., 60+ inch diameter), these flat panel displays can get rather large, bulky, and delicate. For many consumers, a large flat panel display may not even fit in their vehicle and thus require the expense and delay associated with home delivery and even additional expense for mounting the flat panel display on a wall.

Typically, these flat panel displays either couple to external audio systems (e.g., sound bar, multi-speaker stereo, etc.) or include integrated speakers within the flat panel housing. The integrated speakers are usually disposed peripheral to the active display area, such as below, above, left, or right to the display area. As such, conventional audio solutions (integrated or external) position the source of the audio remote from the virtual objects in the image that are supposed to be the source of semantic sounds tracks in the audio. For example, the voice of a person talking in a video does not emanate from a region in the display array proximate to their mouth, but rather from peripheral or external speakers displaced from their mouth. This physical-proximal disparity between image generation and audio emanation reduces the realism and immersion experience of conventional audio/visual systems. In particular, traditional surround-sound systems are unable to simulate realistic localized sound reproduction in a context where there are multiple viewers at different locations within a viewing space.

Figure 1A:
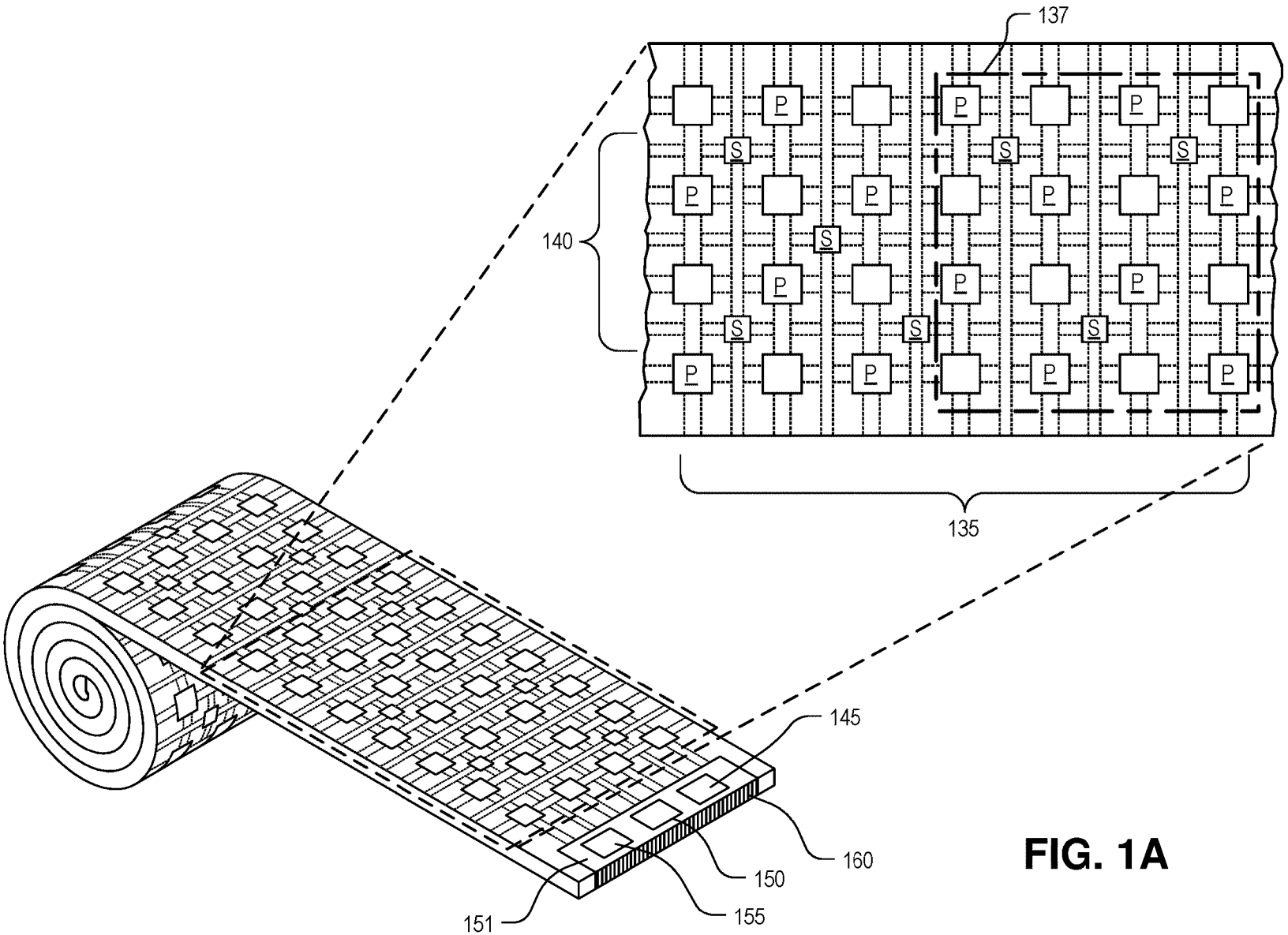
FIG. 1A illustrates a wallpaper-like audio/visual system capable of being rolled for storage and transport and unrolled when deployed and used, in accordance with an embodiment of the disclosure.
Figure 1B:
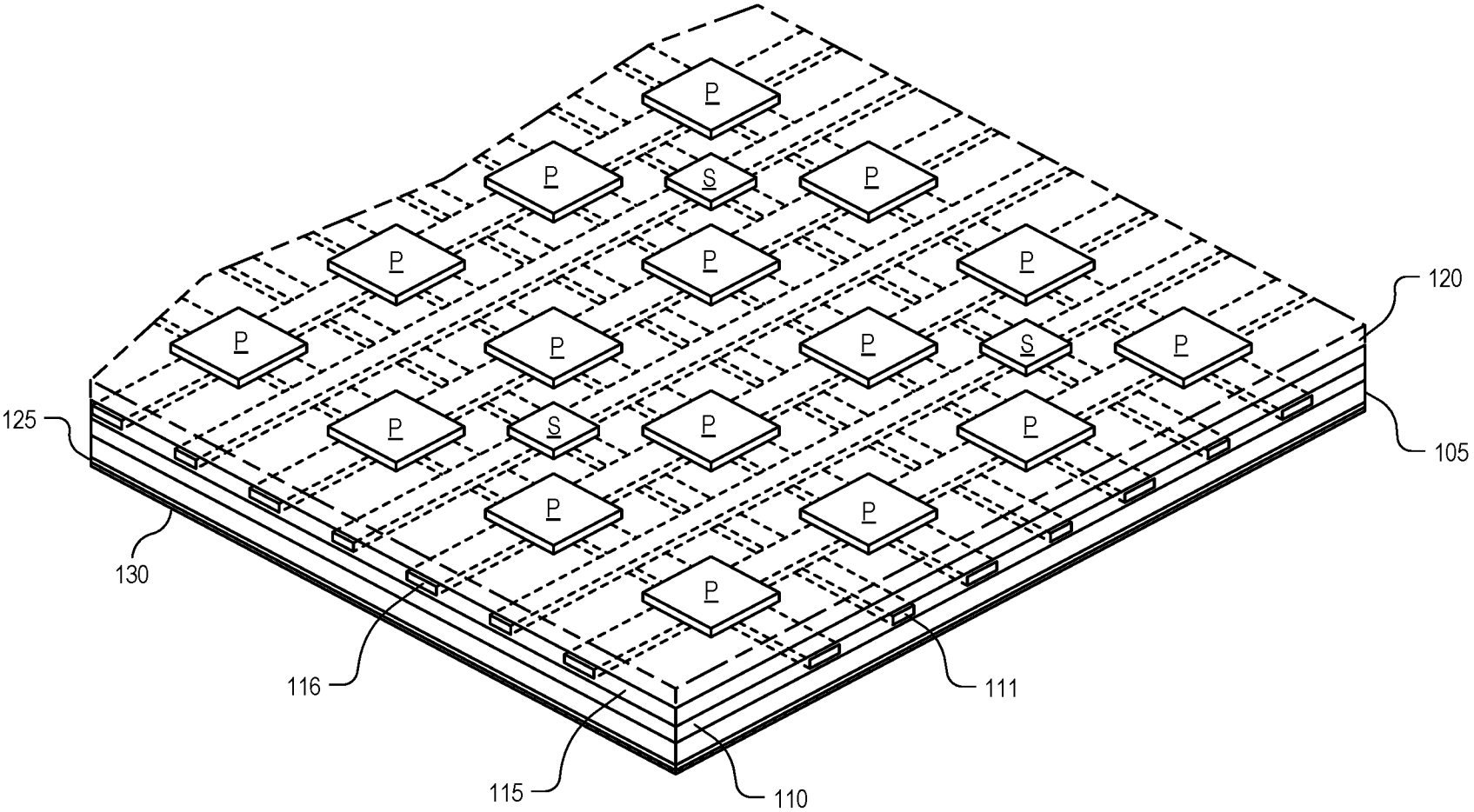
FIG. 1B is a perspective view illustration of components and layers of a wallpaper-like audio/visual system, in accordance with an embodiment of the disclosure.

FIGS. 1A and 1B illustrate a wallpaper-like audio/visual (A/V) system 100 capable of being rolled for storage and transport, and then unrolled when deployed and used, in accordance with an embodiment of the disclosure. FIG. 1A illustrates a perspective view illustration of the roll-to-roll nature of A/V system 100 while FIG. 1B is a perspective view illustration of the material layers and components. The illustrated embodiment of A/V system 100 includes a flexible substrate 105, addressing layers 110 and 115, a component layer 120, an adhesive layer 125, and a removable liner 130 (see FIG. 1B). A/V system 100 further includes a display array 135 including a plurality of display pixels (e.g., micro light emitting diodes), a speaker array 140 including a plurality of micro-speakers, driver circuitry 145, a controller 150, memory 155, and input/output (I/O) ports 160 disposed across the flexible substrate 105 in one or more of the various layers (e.g., component layer 120 and addressing layers 110).

In one embodiment, display array 135 is fabricated from macro-pixel modules P (only a portion are labeled) disposed in the component layer 120. Each macro-pixel module P includes one or more micro-LEDs for emitting pixel light of an image. For example, each macro-pixel module P may include three different colored micro-LEDs (e.g., red, green, and blue) and collectively represent a single multi-color image pixel. In one embodiment, macro-pixel modules P are surface mount components with terminal pads that couple to conductive paths in one or more of the addressing layers to receive power and data signals.

In the illustrated embodiment, speaker array 140 is interspersed amongst the display pixels, or macro-pixel modules P, of display array 135. In one embodiment, speakers are integrated into secondary electronics modules S, which are disposed in the interstitial regions between macro-pixel modules P. As illustrated, secondary electronics modules S, and therefore the speakers of speaker array 140, may be more sparsely populated than the display pixels and macro-pixel modules P of display array 135. The speakers of speaker array 140 may be fabricated using a variety of micro-speaker technologies, such as microelectromechanical system (MEMS) speakers, piezoelectric speakers, capacitive based membrane speakers, electrostatic speakers, magnetic-planar speakers, etc. In the illustrated embodiment, speaker array 140 is also disposed in the component layer 120 and interconnected via conductive paths in one or more of the addressing layers 110, 115. In one embodiment, secondary electronics modules S are also surface mounted components with terminal pads for coupling to addressing layers 110 and/or 115. Although FIGS. 1A and 1B illustrate only a single component layer 120, it should be appreciated that multiple component layers 120 may also be implemented with the display array 135 and speaker array 140 disposed either on the same physical layer, different physical layers, or mixed across multiple physical layers. Although not illustrated, component layer 120 may be overlaid with a clear protective film layer.

The illustrated embodiment of A/V system 100 includes two addressing layers 110 and 115 including flexible conductive paths 111 and 116, respectively, for coupling data and power signals to the devices in component layer 120. Flexible conductive paths 111 and 116 may be fabricated of any flexible conductive materials (e.g., thin metal layers, conductive polymers, conductive graphite, etc.). Addressing layers 110 and 115 may include passivation material surrounding flexible conductive paths 111 and 116 to both passivate and planarize each layer for building up successive material layers. Each addressing layer 110 and 115 may be coupled to layers above or below with conductive vias. Flexible conductive paths 111 and 116 are illustrated as running along orthogonal directions to provide row and column connections between display array 135 and speaker array 140 and driver circuitry 145 and/or controller 150. Of course, other routing configurations may be implemented. Furthermore, although two addressing layers are illustrated, a single layer or more than two layers may be implemented. In yet other embodiments, one or more of the addressing layers may be replaced with wireless data transmission and/or inductive power transmission solutions.

Flexible substrate 105 provides the mechanical support upon which the other layers are built and attached. Flexible substrate 105 may be fabricated of a flexible or elastic material (e.g., flexible polymer) of a desired thickness such that the multi-layer sandwich structure is capable of rolling up, while resisting too tight of bend radiuses that would otherwise damage or separate the electrical components in component layer 120. By keeping the surface mount components in component layer 120 small (e.g., large enough for a few display pixels and related circuitry), the overall structure can bend between the surface mount components without compromising or lifting off the individual macro-pixel modules P or secondary electronics modules S. In yet another embodiment, component layer 120 may be positioned between other flexible layers of the multi-layer stack-up (e.g., between addressing layers 110 and 115, or between addressing layer 110 and flexible substrate 105, etc.) to position component layer 120 at or near the neutral plane to reduce bending stress on the more sensitive components. In this scenario, the material layers positioned over the active emission side of component layer 120 may be transparent layers. In the example where one or more addressing layers 110 or 115 are positioned over component layer 120, flexible conductive paths 111 and 116 may be fabricated of transparent conductive materials (e.g., indium tin oxide).

Adhesive layer 125 may be coated onto the backside of flexible substrate 105 and overlaid with removable liner 130. Adhesive layer 125 and removable liner 130 provide a sort of peel-and-stick mechanism for mounting A/V system 100 to a surface, such as a wall. The peel-and-stick feature along with the rollable nature of A/V system 100 provides a wallpaper-like A/V system 100 that is easily stored and transported with a significantly simplified surface mounting option. While A/V system 100 is well suited for mounting to flat walls, the flexible nature is amenable to mounting on curved surfaces or table-top surfaces. A clear protective layer may be laminated over component layer 120 for improved durability and may also serve as an anti-reflective surface to increase contrast and reduce ambient reflections. It should be appreciated that embodiments of A/V system 100 may also be implemented on a rigid substrate without the flexible feature described herein.

Control and driver electronics may be integrated into A/V system 100 along an end or edge stripe of flexible substrate 105 where I/O ports 160 are positioned. Driver circuitry 145 includes display drivers coupled for driving the display pixels of display array 135 with display signals to emit the display image and audio drivers for driving the micro-speakers of speaker array 140 with audio signals to emanate the audio. Controller 150 is coupled with driver circuitry 145 to provide intelligent routing of the display and audio signals (discussed in greater detail below). Controller 150 is further coupled with memory 155, which includes logic/instructions for performing the intelligent routing. Additionally, memory 155 may store audio/video decoders for decompressing/decoding audio and visual input signals received via I/O ports 160. In one embodiment, I/O ports 160 may be implemented as hardwired connections for receiving power and/or data input signals. In other embodiments, I/O ports 160 may wireless ports or antennas for receiving wireless data signals, and may even include one or more antenna loops extending along the periphery of display array 135 to provide inductive powering of A/V system 100. Accordingly, controller 150 may include a variety of other electronic systems to support various functionality. In one embodiment, electronics region 151, which includes controller 150 and driver circuitry 145, represents electronics that are carried on flexible substrate 105 (directly or indirectly in one or more of the various layers) that are located along one or two sides of display array 135. Electronics region 151 may be reinforced for added rigidity to support larger more complex electronic components. As such, electronics region 151 may be more rigid and less flexible compared to display array 135, which may be rolled without damaging display array 135 and speaker array 140.

Figure 2A:
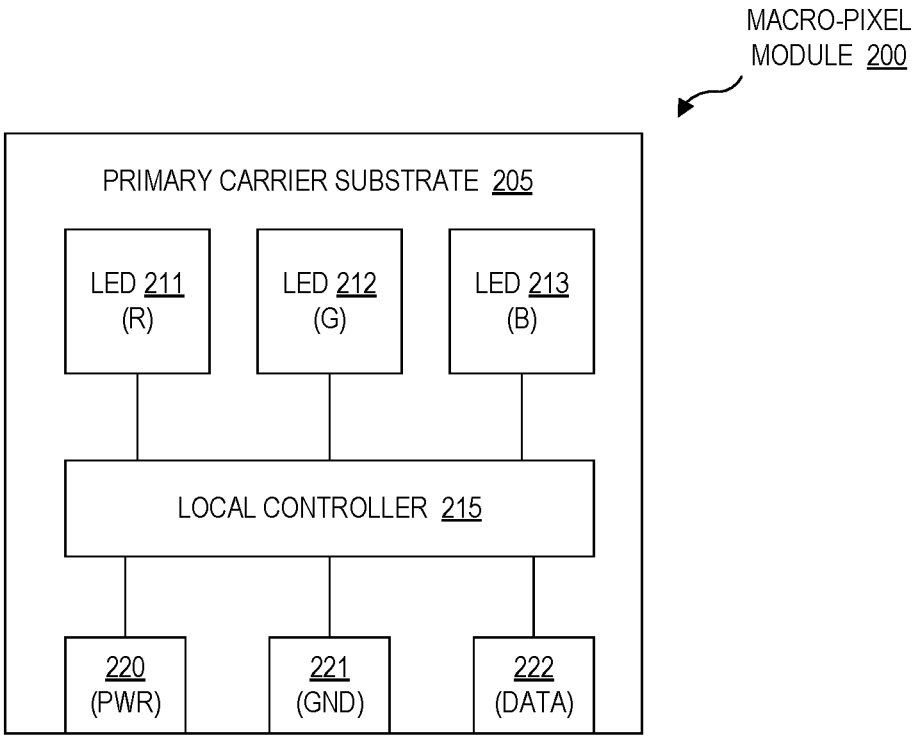
FIG. 2A is a functional block diagram illustrating a macro-pixel module including multiple different colored LEDs, in accordance with an embodiment of the disclosure.
Figure 2B:
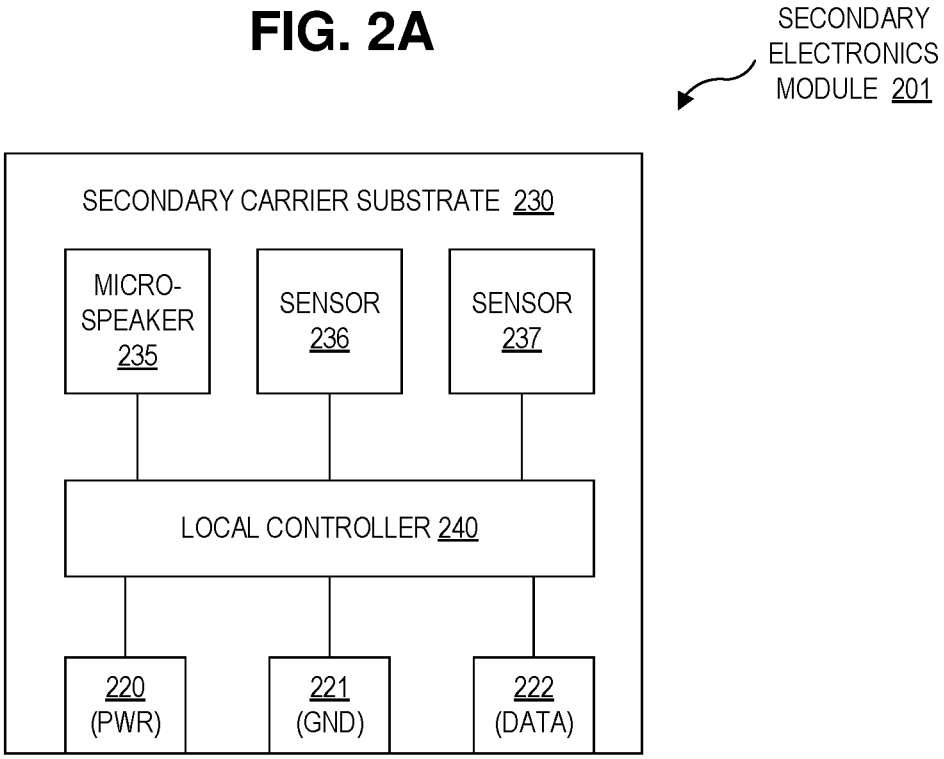
FIG. 2B is a functional block diagram illustrating a secondary electronics module, in accordance with an embodiment of the disclosure.
Figure 2C:
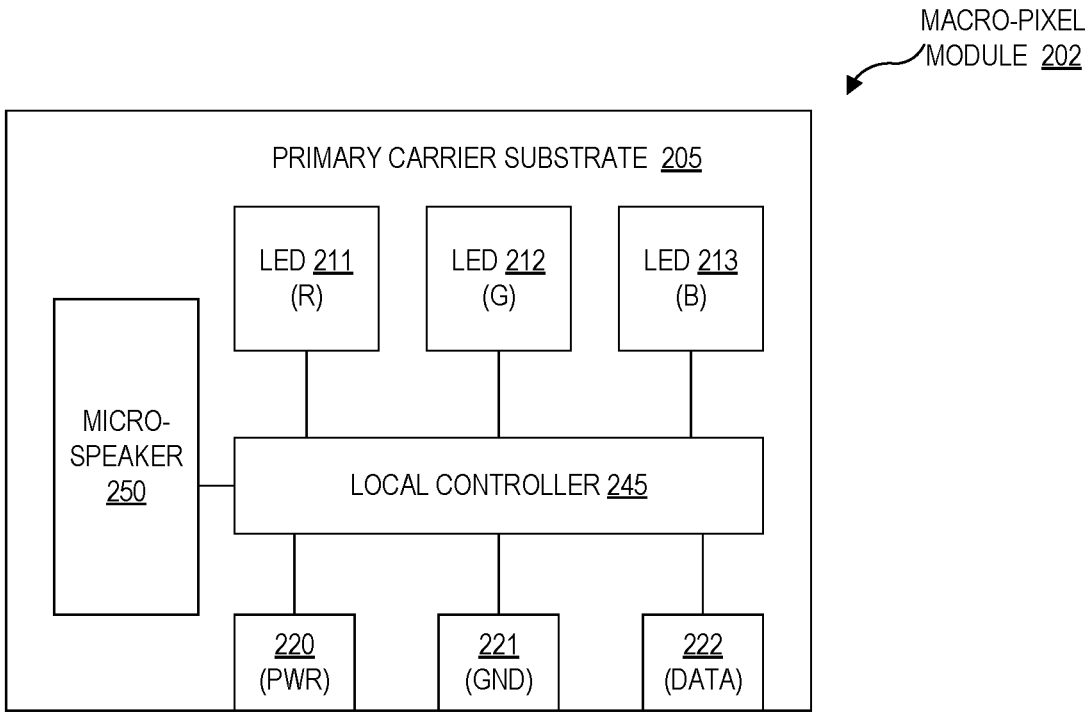
FIG. 2C is a functional block diagram illustrating macro-pixel module, in accordance with another embodiment of the disclosure.

FIGS. 2A-C are functional block diagrams illustrating embodiments of macro-pixel modules P and secondary electronic modules S. FIG. 2A is a functional block diagram illustrating a macro-pixel module 200 including multiple different colored LEDs, in accordance with an embodiment of the disclosure. Macro-pixel module 200 is one possible implementation of macro-pixel modules P in FIGS. 1A and 1B. The illustrated embodiment of macro-pixel module 200 includes a primary carrier substrate 205, different colored LEDs 211, 212, and 213, local controller 215, and terminal pads 220, 221, and 222.

In one embodiment, macro-pixel module 200 includes multi-color LEDs corresponding to a single image pixel. The components of macro-pixel module 200 may be integrated into primary carrier substrate 205, which itself is a surface mount device. For example, macro-pixel module 200 may be a semiconductor chip with integrated components (e.g., application specific integrated circuit). Alternatively, primary carrier substrate 205 may be circuit board and one or more of local controller 215 and LEDs 211-213 may be surface mounted components. The surface mount nature of macro-pixel modules P and/or secondary electronic modules S leverages benefits from discretized components in that a failed module can simply be removed and replaced during manufacture as opposed to discarding the entire display as well.

LEDs 211-213 may correspond to different colors (e.g., red, green, blue). Local controller 215 is provided to received data signals (e.g., a color image signal) from terminal pad 222 and drive LEDs 211-213 to generate the requisite image pixel. Accordingly, local controller 215 operating as a local pixel driver that receives signals (e.g., digital signal) over addressing layers 110 or 115 and appropriately biases LEDs 211-213 to generate the image. Terminal pads 220, 221, and 222 provide power, ground, and data contacts for receiving power and data into macro-pixel module 200 from driver circuitry 145 and/or controller 150. Terminal pads 220, 221, and 222 may be implemented as solder bump pads, wire leads, etc. Although FIG. 2A illustrates three separate contact pads 211-222, more or less contact pads may be implemented. In one embodiment, data may be modulated on top of either power terminal pad 220 or ground terminal pad 221 and appropriate filter electronics included within local controller 215 to extract the data signal. In this embodiment, only two contact pads may be implemented.

FIG. 2B is a functional block diagram illustrating a secondary electronics module 201, in accordance with an embodiment of the disclosure. Secondary electronics module 201 represents one possible implementation of secondary electronic modules S illustrated in FIGS. 1A and 1B. The illustrated embodiment of secondary electronics module 201 includes a micro-speaker 235, sensors 236 and 237, local controller 240, and terminal pads 220-222.

Secondary electronics module 201 is intended to be positioned in the interstitial regions between macro-pixel modules (see FIGS. 1A and 1B), or selectively replace instances of macro-pixel modules in a sparse pattern. Secondary electronics module 201 includes secondary carrier substrate 230 to carry other electronics of A/V system 100 and intersperse those electronics within display array 135. These other electronics include micro-speaker 235 (e.g., MEMS speaker, piezoelectric speaker, capacitive speaker, etc.) and sensors 236 and 237. Sensors 236 and 237 may implement one or more of a proximity sensor, a microphone, a light sensor, a touch sensor, a temperature sensor, a magnetic stylus sensor, ultrasound or radar sensors, other active or passive sensors, or otherwise.

Accordingly, A/V system 100 may include embedded sensor functionality that transforms A/V system 100 into a generalized input/output system that is capable of emitting localized audio/video while also facilitating direct user interactions with the display area. These user interactions may include a touch screen, user proximity sensing, gesture feedback control, etc. By embedding these sensor functions throughout display array 135, the user interaction may be localized to specific objects in the image being displayed and different objects in different regions of the image being displayed may have different interactive characteristics via different sensor modalities. For example, some objects may be touch sensitive virtual objects that leverage sensor 236 (e.g., a pressure or capacitance sensor) while other objects may be light, audio, or temperature sensitive and leverage functionality of sensor 237. In other words, specific sensor instances within display array 135 may be associated with a given virtual object that is proximally coincident with the virtual object and different virtual objects contemporaneously displayed within display array 135 may leverage different sensor types/modalities to exhibit different generalized I/O behavior. For example, one object may be touch sensitive while another object may respond to sounds (e.g., snapping of fingers) immediately in front of the object. Furthermore, the sensors 236 and 237 may be operated by controller 150 as a phased array to provide multi-point sensing and proximal triangulation and disambiguation with external sensory input. Although FIG. 2B illustrates secondary electronics module 201 as including one micro-speaker 235 and two generic sensors 236 and 237, it should be appreciated that secondary electronics module 201 may be implemented without micro-speaker 235, without one or both sensors 236 and 237, or with additional micro-speakers or sensors. FIG. 2B is merely intended to be demonstrative. Similar to macro-pixel module 200, more or less terminal pads 220-222 may be used (e.g., data may be modulated on power or ground).

FIG. 2C is a functional block diagram illustrating a macro-pixel module 202, in accordance with another embodiment of the disclosure. Macro-pixel module 202 is one possible implementation of macro-pixel module P illustrated in FIGS. 1A and 1B. Macro-pixel module 202 is similar to macro-pixel module 200 except that a micro-speaker 250 is included on primary carrier substrate 205. In this embodiment, local controller 245 is also modified for driving both micro-speaker 250 as well as LEDs 211-213 with data signals received over addressing layers 110 and 115. Macro-pixel module 202 may be used to implement all instances of macro-pixel modules P within display array 135, or only select instances of macro-pixel modules P while macro-pixel module 200 implements the majority of the instances of macro-pixel modules P.

Figure 3:
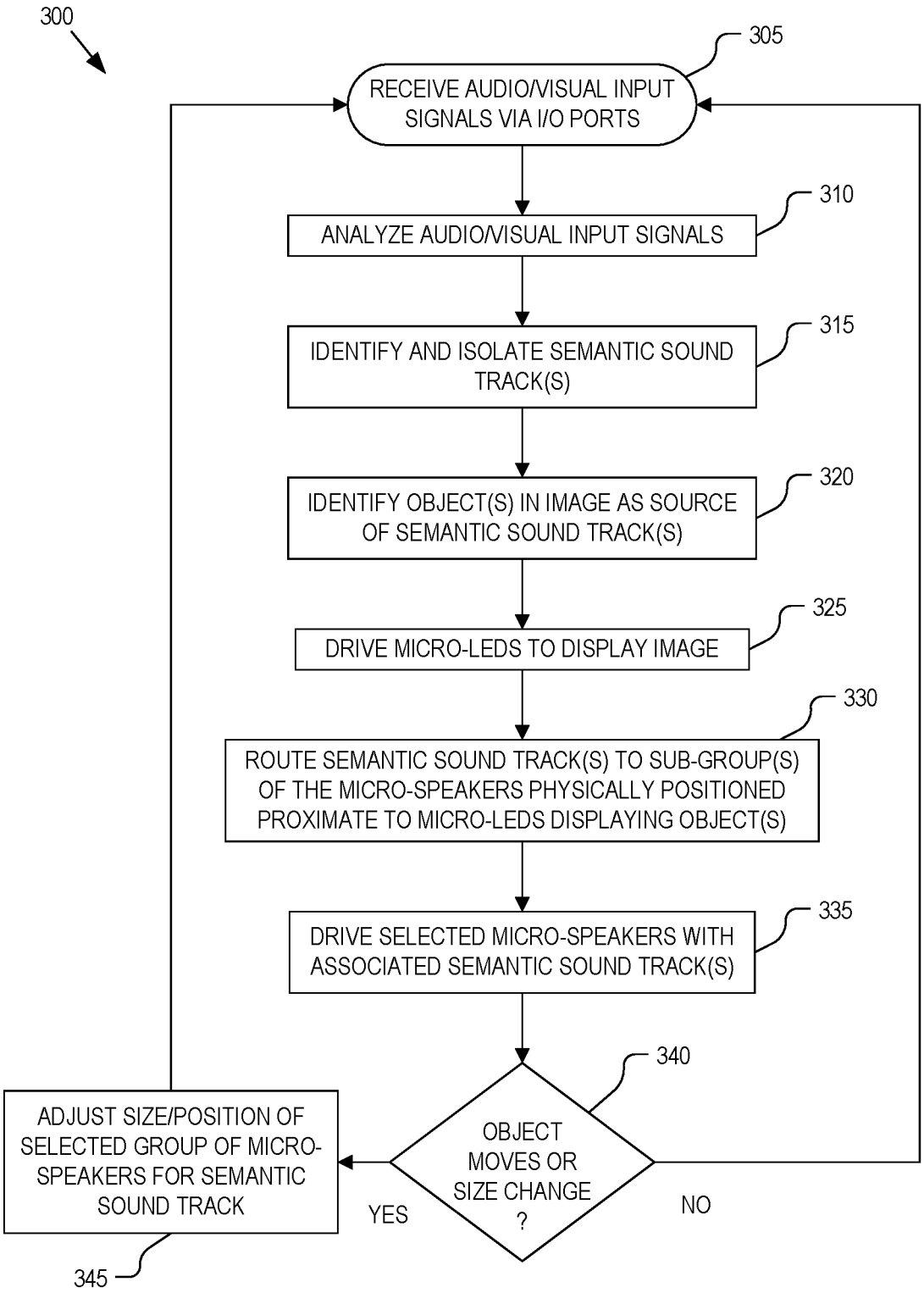
FIG. 3 is a flow chart illustrating a process of operation of an audio/visual system, in accordance with an embodiment of the disclosure.

FIG. 3 is a flow chart illustrating a process 300 of operation of A/V system 100, in accordance with an embodiment of the disclosure. The order in which some or all of the process blocks appear in process 300 should not be deemed limiting. Rather, one of ordinary skill in the art having the benefit of the present disclosure will understand that some of the process blocks may be executed in a variety of orders not illustrated, or even in parallel.

In a process block 305 audio and visual input signals are received via I/O ports 160. I/O ports 160 may be wired or wireless data ports. In one embodiment, I/O ports 160 are conventional A/V connections (e.g., HDMI port, component ports, display port, etc.). In other embodiments, I/O ports 160 may include generic data ports (e.g., USB, USB-C, ethernet, WiFi, etc.).

In a process block 310, the A/V input signals are analyzed by controller 150. The analysis may be executed in real-time contemporaneously with receiving and displaying visual content on display array 135 and outputting audio on speaker array 140. In other embodiments, the analysis may be performed as part of a near real-time buffered analysis or a preprocessing analysis. In other embodiment, the analysis maybe performed off device from A/V system 100.

In the illustrated embodiment, the analysis is executed by controller 150 to identify and isolate semantic sound track(s) in the input audio signal (process block 315) and identify object(s) in the image content as the source(s) of the identified semantic sound tracks (process block 320). A semantic sound track is a voice, music track, or sound that may be logically isolated as a distinct sound from other sounds in the audio input signal. For example, if the audio input signal includes two separate human voices having a conversion, a background musical track, and an environmental noise (e.g., a waterfall), each of these distinct sounds may be identified and isolated as separate semantic sound tracks. Known techniques for identifying and isolating sound tracks may be used. For example, frequency domain analysis may be used to distinguish different frequency sounds. Additionally, a machine learning algorithm may be trained with labelled audio datasets to distinguish human voices, music, and typical environmental noises (e.g., waterfalls, planes, trains, automobiles, etc.). The identified semantic sounds tracks may then be isolated or discretized from each other. For example, various frequency and temporal filters may be used to separate the noises of each semantic sound track from one or more of the other semantic sound tracks.

As mentioned, controller 150 also analyzes the image received in the input video signal to identify objects as potential sources of the identified and isolated semantic sound tracks (process block 320). Again, a machine learning algorithm may be trained on labeled datasets to learn how to associated conventional noises with objects in an image or video feed. For example, the algorithm may be trained to associate moving lips with voice tracks. The algorithm may be further trained to disambiguate male and female voices, adult voices from children voices, etc. Furthermore, movement in the images may be analyzed for coincident starting and/or stopping points between object motions and sounds to further identify the source objects to the semantic sound tracks.

In a process block 325, the input visual signal is passed to driver circuitry 145, which drives display array 135 via a first group of flexible conductive paths in one or more addressing layers 110 and 115 to output the image. Driver circuitry 145 also drives speaker array 140 via a second group of flexible conductive paths in one or more addressing layers 110 and 115 to emit the audio. However, in process block 330, driver circuitry 145, under the influence of controller 150, routes each of the semantic sound tracks to various sub-groups of the micro-speakers within speaker array 140 that are physically positioned proximate to the specific micro-LEDs (or macro-pixel modules P) actually displaying the corresponding objects that are determined to be the source of the respective semantic sound track(s). For example, referring to FIG. 1A, if the display pixels within sub-group 137 are determined to be the display pixels actively displaying the image associated with the object or virtual object that has been determined to be the source of a given semantic sound track, then the audio of the isolated semantic sound track is routed via addressing layers 110 and/or 115 to micro-speakers (or secondary electronics modules S) within or proximate to sub-group 137. Thus, the semantic sound tracks are separately routed to different physical locations within display array 135 such that the audio emanates from proximal physical locations with the source objects in the image (process block 335). Additionally, if the source object of a semantic sound track changes size on the display array 135, such as the image zooms in or out, or the object is moving towards or away from the camera position in the image (decision block 340), then the size and or position of the sub-group of micro-speakers that are emitting the semantic sound track may also be adjusted to match the size and position of the source object. This dynamic matching, and re-matching, of size and physical position between semantic sound tracks and source objects in the image provides for increased realism and viewer immersion.

Figure 4:
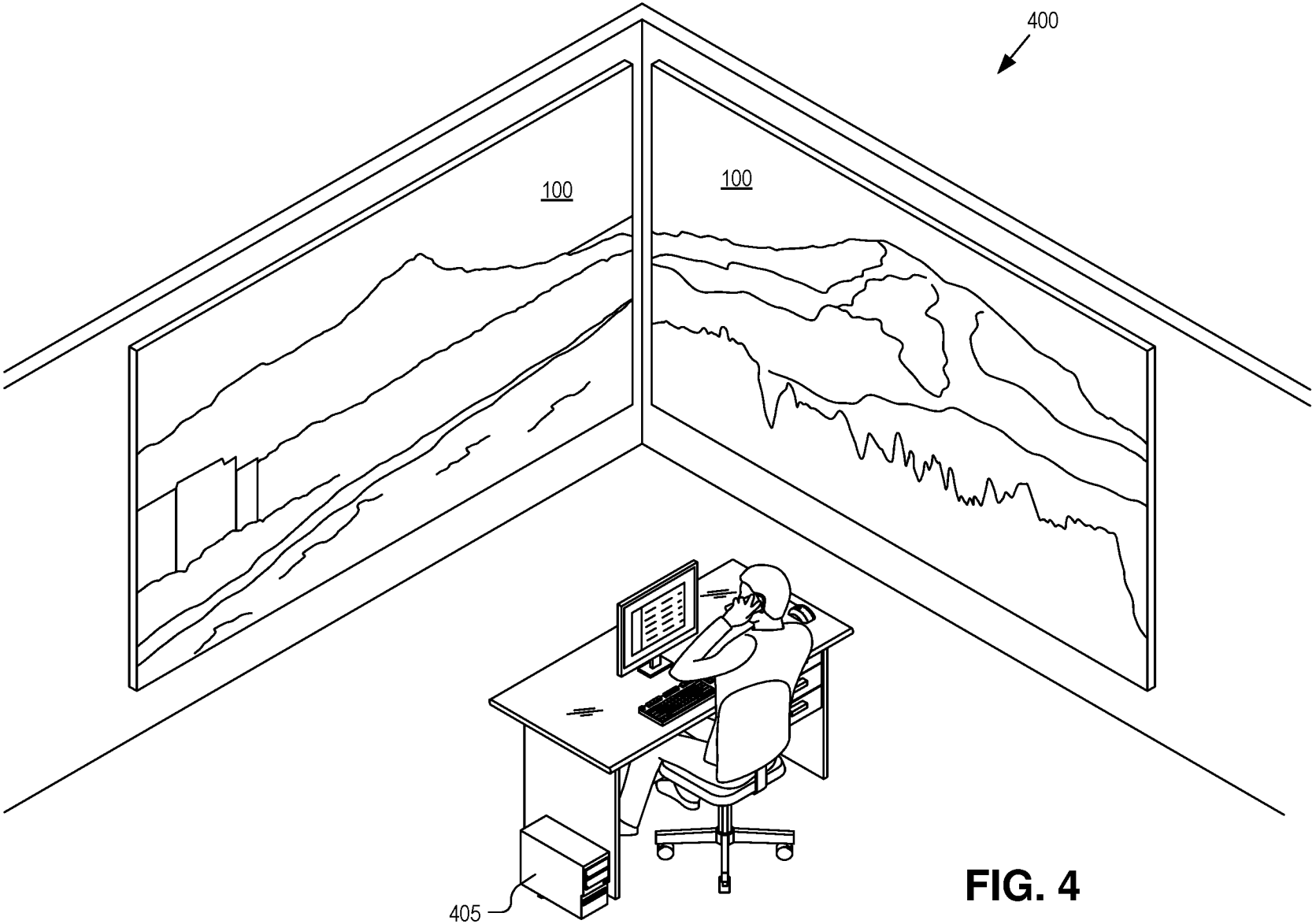
FIG. 4 is a perspective view illustration of an immersive sensory environment that uses wallpaper-like audio/visual systems, in accordance with an embodiment of the disclosure.

FIG. 4 is a perspective view illustration of an immersive sensory environment 400 that uses wallpaper-like A/V systems 100, in accordance with an embodiment of the disclosure. As illustrated, wallpaper-like A/V systems 100 may be easily mounted to multiple walls via a simple peel-and-stick solution. By providing A/V systems 100 throughout a room, the user's vision is immersed. The integrated speaker arrays interspersed within each display array 135 provides further realism and immersion by providing collocated audio and visual elements where the source of the audio production not only moves with the location of the virtual source object but also matches its physically displayed size or extent. For example, the voice of a person is perceived to emanate from their lips, the sound of a vehicle is perceived to follow and emanate from the car, and the sound of an avalanche can be distributed over the portion of the image actually displaying the avalanche. Other sensors maybe embedded into display array 135 via sensors 236, 237 of secondary electronic modules S to further facilitate natural user interactions with displayed images and objects within those images. As mentioned, the processing associated with this functionality may be performed onboard within controller 150 or offloaded to an external controller, such as computer 405.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A wallpaper-like audio/visual system, comprising:

a flexible substrate;

a display array disposed across the flexible substrate and including micro light emitting diodes (micro-LEDs) to emit an image;

a plurality of speakers disposed across the flexible substrate to emit audio, the speakers interspersed amongst the micro-LEDs;

one or more addressing layers disposed across the flexible substrate, the one or more addressing layers including a first group of flexible conductive paths coupled to the micro-LEDs to selectively drive the micro-LEDs with first signals to emit the image and a second group of flexible conductive paths coupled to the speakers to drive the speakers with second signals to emit the audio;

driver circuitry carried on the flexible substrate and coupled to the first and second groups of flexible conductive paths to drive the micro-LEDs and the speakers with the first and second signals, respectively, in response to receiving audio and visual input signals; and a controller coupled with the driver circuitry, the controller including memory storing instructions, that when executed by the controller, cause the wallpaper-like audio/visual system to perform operations including:

identifying an object in the image as a source of a semantic sound track in the audio; and routing the semantic sound track predominately or exclusively to a sub-group of the speakers physically positioned proximate to one or more of the micro-LEDs displaying the object in the image.

2. The wallpaper-like audio/visual system of claim 1, wherein the flexible substrate, the display array, the speakers, and the one or more addressing layers collectively form a multi-layer sandwich structure that is rollable without damaging the display array or the speakers.

3. The wallpaper-like audio/visual system of claim 2, further comprising:

an adhesive layer disposed on a backside of the flexible substrate opposite a frontside of the flexible substrate across which the display array is disposed; and a removable liner disposed over the adhesive layer, wherein the removable liner is peelable to expose the adhesive layer when mounting the wallpaper-like audio/visual system.

4. The wallpaper-like audio/visual system of claim 2, wherein the flexible substrate comprises a flexible polymer substrate and the one or more addressing layers comprise one or more passivation-planarization layers having the first and second group of flexible conductive paths disposed therein, and wherein the one or more addressing layers are disposed between the flexible substrate and a component layer including the display array.

5. The wallpaper-like audio/visual system of claim 1, wherein the display array comprises an array of macro-pixel modules disposed across the flexible substrate, wherein each of the macro-pixel modules comprises:

a primary carrier substrate;

multiple different colored LEDs disposed on the primary carrier substrate;

a local controller disposed on the primary carrier substrate and coupled to the multiple different colored LEDs to drive the multiple different colored LEDs; and terminal pads disposed on the primary carrier substrate to couple the local controller to one or more of the first group of the flexible conductive paths.

6. The wallpaper-like audio/visual system of claim 5, wherein the macro-pixel modules comprise surface mounted components.

7. The wallpaper-like audio/visual system of claim 5, wherein a portion of the macro-pixel modules each further includes one of the speakers disposed on the primary carrier substrate.

8. The wallpaper-like audio/visual system of claim 5, further comprising secondary electronics modules distinct from the macro-pixel modules, the secondary electronic modules disposed in interstitial regions between the macro-pixel modules, each of the secondary electronics modules comprising:

a secondary carrier substrate; and secondary electronic components, different than the micro-LEDs, disposed on the secondary carrier substrate.

9. The wallpaper-like audio/visual system of claim 8, wherein the secondary electronics modules are sparse relative to the macro-pixel modules.

10. The wallpaper-like audio/visual system of claim 9, wherein the secondary electronic components of each of the secondary electronics modules include one or more of the speakers, a proximity sensor, a microphone, a temperature sensor, a light sensor, a touch sensor, a magnetic stylus sensor, an ultrasound sensor, a radar sensor, a passive sensor, or an active sensor.

11. The wallpaper-like audio/visual system of claim 1, wherein identifying the object in the image as the source of the semantic sound track in the audio comprises:

analyzing the audio input signal to isolate the semantic sound track from other semantic sound tracks; and analyzing the visual input signal to identify the object in the image deemed to be the source for the semantic sound track.

12. The wallpaper-like audio/visual system of claim 11, wherein analyzing the visual input signal to identify the object in the image as the source for the semantic sound track comprises:

analyzing the audio input signal and the visual input signal for coincident starting points of sounds and object motions.

13. The wallpaper-like audio/visual system of claim 1, wherein the controller is carried on the flexible substrate and the identifying is performed in real-time with receiving the audio and visual input signals.

14. The wallpaper-like audio/visual system of claim 1, wherein the memory stores further instructions, that when executed by the controller, cause the wallpaper-like audio/visual system to perform additional operations including:

adjusting a size or a position of the sub-group of the speakers when the object being displayed by the one or more of the micro-LEDs changes a size or a position in the image.

15. A display system, comprising:

a display array of display pixels to emit an image;

an array of speakers to emit audio, the speakers interspersed amongst the display pixels;

driver circuitry coupled to the display array and the array of speakers to drive the display pixels and the speakers with the first and second signals, respectively, in response to receiving audio and visual input signals; and a controller coupled to the driver circuitry, the controller including memory storing instructions, that when executed by the controller, cause the display system to perform operations including:

identifying an object in the image as a source of a semantic sound track in the audio; and dynamically routing the semantic sound track predominately or exclusively to a sub-group of the speakers physically positioned proximate to one or more of the display pixels displaying the object in the image.

16. The display system of claim 15, wherein identifying the object in the image as the source of the semantic sound track in the audio comprises:

analyzing the audio input signal to isolate the semantic sound track from other semantic sound tracks; and analyzing the visual input signal to identify the object in the image as the source for the semantic sound track.

17. The display system of claim 16, wherein analyzing the visual input signal to identify the object in the image as the source for the semantic sound track comprises:

analyzing the audio input signal and the visual input signal for coincident starting points of sounds and object motions.

18. The display system of claim 15, wherein the memory stores further instructions, that when executed by the controller, cause the wallpaper-like audio/visual system to perform additional operations including:

adjusting a size or a position of the sub-group of the speakers when the object being displayed changes a size or a position in the image.

19. The display system of claim 15, wherein the display array comprises an array of micro-LEDs disposed on a flexible substrate and the array of speakers comprises speakers disposed in interstitial regions between the micro-LEDs of the display array on the flexible substrate, the display system further comprising:

one or more addressing layers disposed across the flexible substrate, the one or more addressing layers including a first group of flexible conductive paths coupled to the micro-LEDs to selectively drive the micro-LEDs with first signals to emit the image and a second group of flexible conductive paths coupled to the speakers to drive the speakers with second signals to emit the audio.

20. The display system of claim 19, wherein the display array comprises an array of macro-pixel modules disposed across the flexible substrate, wherein each of the macro-pixel modules comprises:

a primary carrier substrate;

multiple different colored LEDs disposed on the primary carrier substrate;

a local controller disposed on the primary carrier substrate and coupled to the multiple different colored LEDs to drive the multiple different colored LEDs; and terminal pads disposed on the primary carrier substrate to couple the local controller to one or more of the first group of the flexible conductive paths.

21. The display system of claim 20, wherein the macro-pixel modules comprise surface mounted components that are surface mounted over the flexible substrate.

22. A wallpaper-like audio/visual system, comprising:

a flexible substrate;

a display array disposed across the flexible substrate and including micro light emitting diodes (micro-LEDs) to emit an image;

a plurality of speakers disposed across the flexible substrate to emit audio, the speakers interspersed amongst the micro-LEDs;

one or more addressing layers disposed across the flexible substrate, the one or more addressing layers including a first group of flexible conductive paths coupled to the micro-LEDs to selectively drive the micro-LEDs with first signals to emit the image and a second group of flexible conductive paths coupled to the speakers to drive the speakers with second signals to emit the audio; and driver circuitry carried on the flexible substrate and coupled to the first and second groups of flexible conductive paths to drive the micro-LEDs and the speakers with the first and second signals, respectively, in response to receiving audio and visual input signals, wherein the display array comprises an array of macro-pixel modules disposed across the flexible substrate, wherein each of the macro-pixel modules includes:

a primary carrier substrate;

multiple different colored LEDs disposed on the primary carrier substrate;

a local controller disposed on the primary carrier substrate and coupled to the multiple different colored LEDs to drive the multiple different colored LEDs; and terminal pads disposed on the primary carrier substrate to couple the local controller to one or more of the first group of the flexible conductive paths.

* * * * *